United States Patent [19]

Turnheim et al.

[11] 3,957,280

[45] May 18, 1976

[54] SKI BOOT

[75] Inventors: Georg Turnheim, Schwechat; Axel Kubelka, Vienna, both of Austria

[73] Assignee: Gertsch AG, Zug, Switzerland

[22] Filed: June 22, 1973

[21] Appl. No.: 372,827

[30] Foreign Application Priority Data

June 23, 1972 Austria ..... 5403/72

[52] U.S. Cl. ..... 280/613; 280/636; 36/117

[51] Int. Cl.[2] ..... A63C 9/00

[58] Field of Search ..... 280/11.35 R, 11.35 D, 280/11.35 T, 11.35 L, 11.35 C, 11.35 M; 36/2.5 AL, 2.5 R

[56] References Cited

UNITED STATES PATENTS

| | | | |
|---|---|---|---|
| 2,725,648 | 12/1955 | Kirk et al. | 36/2.5 R |
| 3,061,325 | 10/1962 | Glass | 280/11.35 D |
| 3,353,835 | 11/1967 | Sommer | 280/11.35 M |
| 3,677,567 | 7/1972 | Salomon | 280/11.35 C |
| 3,785,668 | 1/1974 | Marker | 280/11.35 R |

*Primary Examiner*—Frank E. Werner
*Assistant Examiner*—James M. Slattery
*Attorney, Agent, or Firm*—Woodhams, Blanchard and Flynn

[57] ABSTRACT

Ski boot having part of the binding in a suitable recess in the sole of the boot. The part of the binding in the recess cooperates as desired with the other binding part which latter is fixed to the ski. In this invention the recess is transverse of the boot and open at both ends. The boot sole may be longitudinally curved on the bottom thereof to facilitate walking. Ribs may be provided within the recess to urge snow and ice outwardly through its open ends as such snow and ice is packed thereinto.

7 Claims, 4 Drawing Figures

SKI BOOT

The invention relates to a ski boot having a recess in its sole for receiving ski binding parts which cooperate with associated binding parts arranged on the ski.

The known ski boots adapted to receive binding parts within the sole are not only constructed very rigidly which causes the skier to become quickly tired during walking but also makes very difficult the removal of snow, ice, dirt and the like which may have entered thereinto. Usually there is provided only a downwardly opening recess from which snow, ice or the like is difficult to remove. Further, the normally present stiff sole does not permit during walking the natural rolling movement of the foot.

Accordingly, the purpose of the invention is to avoid these disadvantages and the invention is characterized in that the recess is constructed as a groove which extends transversely to the longitudinal direction of the boot and is open at the ends and in that advantageously the stepping surface of the sole is curved both toward the heel and toward the tip.

From the transversely extending recess which is open at the ends, any snow, ice or the like which may adhere thereto can be easily removed. It is particularly advantageous if during walking such possibly adherent snow or ice is pressed automatically to the side, particularly by providing ribs at the bottom of the transversely extending groove or at the upper side of the ski mounted binding parts. Additionally walking is made easier through the curvature of the stepping surface.

The subject matter of the invention is illustrated examplarily in several embodiments in the drawings, in which.

Figure 1:
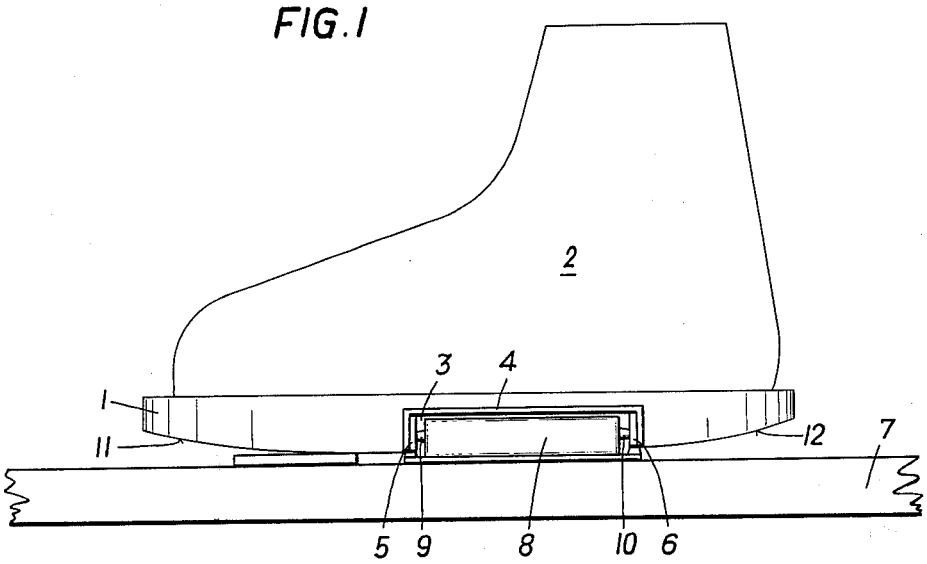
FIG. 1 is a side view of a ski boot arranged on the ski.

As will be apparent in FIG. 1, a groove 3 is provided in the sole 1 of the ski boot 2, said groove extending transversely to the longitudinal direction of the boot and being open at its ends. In this groove 3 the ski binding part 4 is supported and carries two parts 5, 6 forming locking receptacles. The binding part 8 provided on the ski 7 has two spring-loaded locking elements 9, 10 which engage the locking receptacles formed by the parts 5, 6.

During an overload, for example during a fall, the ski boot 2 can be released both laterally and also upwardly by pressing the spring-loaded locking elements 9, 10 from the parts 5, 6 forming the locking receptacles. For stepping into the binding system, the ski boot 2 is pressed in a simple manner to place the recess 3 onto the binding part 8 arranged on the ski 7.

Figure 2:
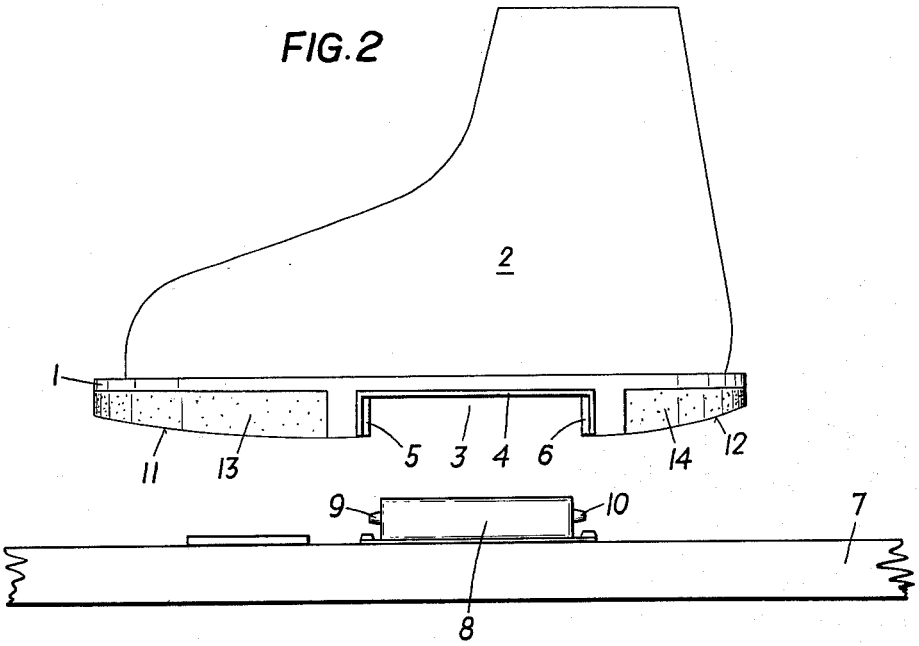
FIG. 2 illustrates a ski with a ski boot lifted off therefrom.

The stepping surface of the sole 1 has both toward the tip and also toward the heel respectively appropriate curved surfaces 11, 12 by means of which the ski boot can properly roll during walking. In order to make walking yet more easy, the stepping surface can be formed in the area of the curvatures 11, 12 according to FIG. 2 of elastic material 13, 14, such as rubber, plastic or the like.

Figure 3:
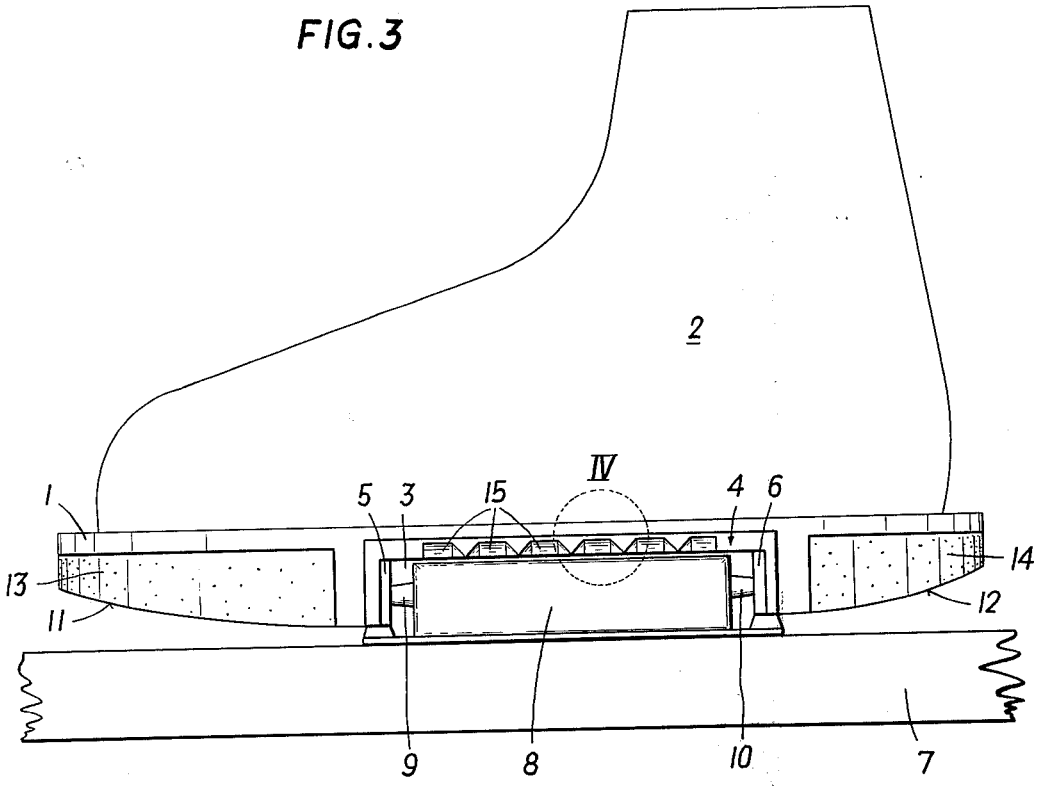
FIG. 3 is a further embodiment.
Figure 4:
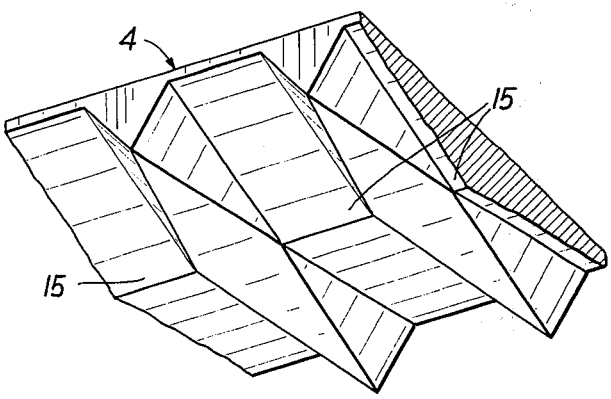
FIG. 4 illustrates the detail IV according to FIG. 3 in a view from below in an oblique direction.

According to FIGS. 3 and 4 ribs 15 are provided at the bottom of the transversely extending recess. When the ski boot is set down onto snow, ice or the like which may stick thereto, same is pressed to the side by these ribs 15 and in this manner the correct engagement of the spring-loaded locking elements 9, 10 into the corresponding locking receptacles of the parts 5, 6 is assured. In this manner the removal of possibly adherent snow or ice takes place practically automatically. In other possible embodiments this removal can also take place partly automatically or such adherent snow, ice or the like can be wiped off manually in a simple manner toward one of the open sides of the recess.

The invention is not limited to the illustrated exemplary embodiments. A number of further embodiments exist which lie within the scope of the invention. For example, in a similar manner it would also be possible to provide ribs at the upper side of the binding parts which ribs can cooperate either with a smooth bottom surface of the recess or with the ribs illustrated in the embodiment of FIGS. 3 and 4.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. In a ski boot having a sole with a bottom surface and adapted to cooperate with safety releasable securement means mounted on the upper surface of a ski for securing said ski boot to said ski, the improvement comprising:

means defining a recess in the bottom surface of said sole, said recess extending laterally of the longitudinal direction of said sole and opening outwardly at both sides and entirely along the bottom of said sole leaving longitudinally spaced and separate end sole portions, said releasable securement means being adapted to be received in said recess whereby snow and the like can be discharged from said recess through said open sides and bottom and said securement means can be discharged through said sides and bottom; and curved surface means on the bottom of each of said end sole portions, said curved surface means curving upwardly at the remote longitudinal ends of each of said sole portions so that the remote ends of said sole are spaced upwardly from the upper surface of said ski to be free of hampering the release function of said safety releasable securement means caused by an engagement thereof with said upper surface of said ski, said remote longitudinal ends of each of said sole portions being free of engagement with said releasable securement means whereby said releasable securement means in said recess provides the sole connection of said ski boot to said ski.

2. A ski boot according to claim 1, wherein said curved surface means on said sole is formed of elastic material, such as rubber, plastic or the like.

3. A ski boot according to claim 1, including laterally extending rib means being positioned adjacent the bottom of said laterally extending recess, said rib means being secured to at least one of said bottom of said recess and the top surface of said safety releasable securement means, said laterally extending rib means including means for effecting an automatic ejection of snow and the like from said recess when said ski boot is moved vertically relative to said ski with said safety releasable securement means being received in said recess to secure said ski boot to said ski.

4. A ski boot construction, comprising:

a sole on said ski boot;

means defining a recess in the bottom surface of said sole, said recess extending laterally of the longitudinal direction of said sole and opening outwardly at both sides and entirely along the bottom of said sole leaving longitudinally spaced and separate end sole portions, the width of said openings at both sides and along said bottom of said sole being equal to the width of said recess; and laterally extending rib means mounted on the bottom of said laterally extending recess, said laterally extending rib means including means for effecting an automatic ejection of snow and the like from said recess out through said sides when said ski boot is moved vertically relative to a ski.

5. A ski boot construction, comprising:

a sole on said ski boot;

means defining a recess in the bottom surface of said sole, said recess extending laterally of the longitudinal direction of said sole and opening outwardly at both sides and entirely along the bottom of said sole leaving longitudinally spaced and separate end sole portions, the width of said openings at both sides and along said bottom of said sole being equal to the width of said recess;

safety releasable securement means secured to the upper surface of a ski and adapted to be received in said recess; and curved surface means on the bottom of each of said end sole portions, said curved surface means curving upwardly at the remote longitudinal ends of each of said end sole portions so that the remote ends of said sole are spaced upwardly from the upper surface of said ski to be free of hampering the release function of said safety releasable securement means caused by an engagement thereof with said upper surface of said ski.

6. A ski boot construction, comprising:

a sole on said ski boot;

means defining a single recess in the bottom surface of said sole, said single recess extending laterally of the longitudinal direction of said sole and opening outwardly at both sides and entirely along the bottom of said sole leaving longitudinally spaced and separate end sole portions, the width of said openings at both sides and along said bottom of said sole being equal to the width of said single recess;

safety releasable securement means secured to the upper surface of a ski and to said sole in said recess for releasably holding said ski boot to said ski, said safety releasable securement means providing the only holding connection of said ski boot to said ski; and snow ejecting means mounted on one of the bottom of said single recess and a surface of said safety releasable securement means for automatically ejecting snow and the like from said recess out through said sides when said ski boot is moved vertically relative to said ski.

7. A ski boot construction, comprising:

a sole on said ski boot;

means defining a single recess in the bottom surface of said sole, said single recess extending laterally of the longitudinal direction of said sole at generally the longitudinal central part of said sole and opening outwardly at both sides and entirely along the bottom of said sole leaving only a pair of longitudinally spaced and separate end sole portions, the width of said openings at both sides and along said bottom of said sole being equal to the width of said single recess; and safety releasable securement means secured to the upper surface of a ski and to said sole in said single recess for releasably holding said ski boot to said ski, said safety releasable securement means providing the only holding connection of said ski boot to said ski.

* * * * *